US006757951B2

(12) United States Patent
Sawdon et al.

(10) Patent No.: US 6,757,951 B2
(45) Date of Patent: Jul. 6, 2004

(54) COMPOSITE URETHANE STRIPPER FOR METAL JOINING APPARATUS

(75) Inventors: Edwin G. Sawdon, St. Clair, MI (US); Steven J. Sprotberry, Marysville, MI (US)

(73) Assignee: BTM Corporation, Marysville, MI (US)

( * ) Notice: Subject to any disclaimer, the term of this patent is extended or adjusted under 35 U.S.C. 154(b) by 0 days.

(21) Appl. No.: 10/191,839

(22) Filed: Jul. 9, 2002

(65) Prior Publication Data

US 2002/0178776 A1 Dec. 5, 2002

Related U.S. Application Data

(63) Continuation-in-part of application No. 09/707,258, filed on Nov. 6, 2000, now Pat. No. 6,430,795.

(51) Int. Cl.[7] ..... B23P 11/00
(52) U.S. Cl. ..... 29/243.5; 29/509
(58) Field of Search ..... 29/243.5, 509, 29/243.52, 243.53, 283.5, 21.1, 522.1, 527.1, 505, 798, 569

(56) References Cited

U.S. PATENT DOCUMENTS

| | | | | | |
|---|---|---|---|---|---|
| 3,579,809 | A | * | 5/1971 | Wolf et al. | 29/509 |
| 5,267,383 | A | * | 12/1993 | Sawdon | 29/243.5 |
| 5,315,743 | A | | 5/1994 | Schleicher | |
| 5,689,872 | A | * | 11/1997 | Forsline | 29/515 |
| 5,709,019 | A | | 1/1998 | Sawdon | |
| 6,052,887 | A | * | 4/2000 | Dziadosz et al. | 29/509 |
| 6,430,795 | B1 | * | 8/2002 | Sawdon et al. | 29/243.5 |

* cited by examiner

*Primary Examiner*—Joseph J. Hail, III
*Assistant Examiner*—Daniel G. Shanley
(74) *Attorney, Agent, or Firm*—Harness, Dickey & Pierce, P.L.C.

(57) ABSTRACT

A composite stripper for use in conjunction with an apparatus for joining multiple pieces of sheet metal or other sheet material is disclosed. The composite stripper is an elongated cylindrical member having a compliant distal engagement portion which is compressible to clamp sheet materials tightly together and a relatively hard proximate portion to provide an adequate interface between the punch assembly and the material to be joined.

13 Claims, 3 Drawing Sheets

COMPOSITE URETHANE STRIPPER FOR METAL JOINING APPARATUS

This application is a continuation-in-part of application Ser. No. 09/707,258, filed Nov. 6, 2000 now U.S. Pat. No. 6,430,795.

BACKGROUND AND SUMMARY OF THE INVENTION

The present invention relates generally to joining sheet material, and more particularly to a molded stripper for use in the joining apparatus to form leak-proof or non-leak-proof joints.

The ability to permanently join multiple pieces of sheet material through punching or other manipulation and deforming them into an interlocking relationship has found widespread applications. In this regard, such method and apparatuses for permanently joining sheet metal or other sheet material items, with the capability of forming either leak-proof joints or conventional "lanced joints" has been the subject of numerous patents. Such apparatuses include die members that are movable laterally, transverse to the longitudinal movement of a punch against an anvil between the dies which are relatively simple but durable in construction, which utilize standard or specialized punches, which are compact and suitable in many different applications, which preserve the corrosive resistance of coated sheet material being joined, and which are suitable for use either in a small press or in a C-frame holder of a large press. In this regard, U.S. Pat. No. 5,581,860 and the related U.S. patents identified therein are exemplary of this technology. The disclosure of all such patent applications and issued U.S. patents are expressly incorporated by reference herein.

In pertinent part to the present invention, U.S. Pat. No. 5,581,860 discloses a punch assembly having a punch body mounting a circular punch. The circular punch includes a threaded portion which receives and threadingly supports a stripper retainer. Disposed within the stripper retainer is a stripper or sheet metal retainer biased to a stripping position by means of a coil spring. The stripper serves to clamp sheet material together before and during the formation of the joint. The stripper preferably has an outside diameter at the area of longitudinal engagement with the sheet metal to be formed that is greater than the inside diameter of the die opening when the dies are at their maximum laterally outward open position. This, coupled with biasing forces urging the stripper longitudinally against the sheet metal surrounding the joint in order to clamp the sheet metal pieces together, greatly reduces the tendency for the sheet material to flow longitudinally outward, away from the preferably fixed anvil inside of the die opening.

The coil spring used to generate the stripper biasing force has a tendency to degrade during repeated cycling. More specifically, the clamping forces generated by the stripper decrease as the stripper is repeatedly cycled, and may ultimately fail in a fatigue mode. Likewise, the metal tip of the stripper which contact the sheet material may scratch or mar the material being stripped. Although the prior art strippers perform satisfactorily, the present application is directed to additional improvements and refinements thereupon.

In accordance with the present invention, as defined in the appended claims, a composite urethane stripper is provided for use in conjunction with various punch assemblies to provide sufficient force to clamp the sheet materials tightly together before and during the forming of the joint. As presently preferred, the composite stripper utilizes two components of urethane having different hardness—an end portion utilizing a relatively hard durometer urethane and a middle portion utilizing a relatively soft durometer urethane. The configuration of the stripper is such that the clamping force may be accurately and repeatedly controlled.

These features, along with others discussed in more detail below provide a stripper for use in die assemblies of forming apparatuses that are more durable and reliable, more versatile, more stable, more widely applicable, and that typically require less maintenance to operate than previous strippers.

These and other objects, features and advantages of the present invention will become apparent from the subsequent description and the appended claims, taking in conjunction with the accompanying drawings.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

Figure 1:
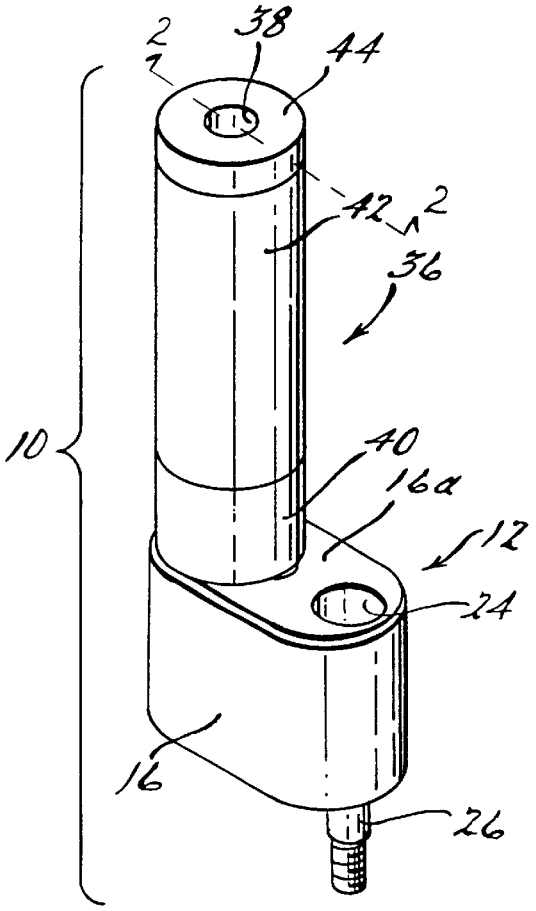
FIG. 1 is a perspective view of a punch assembly having a molded three-piece composite urethane stripper according to a first embodiment.
Figure 2:
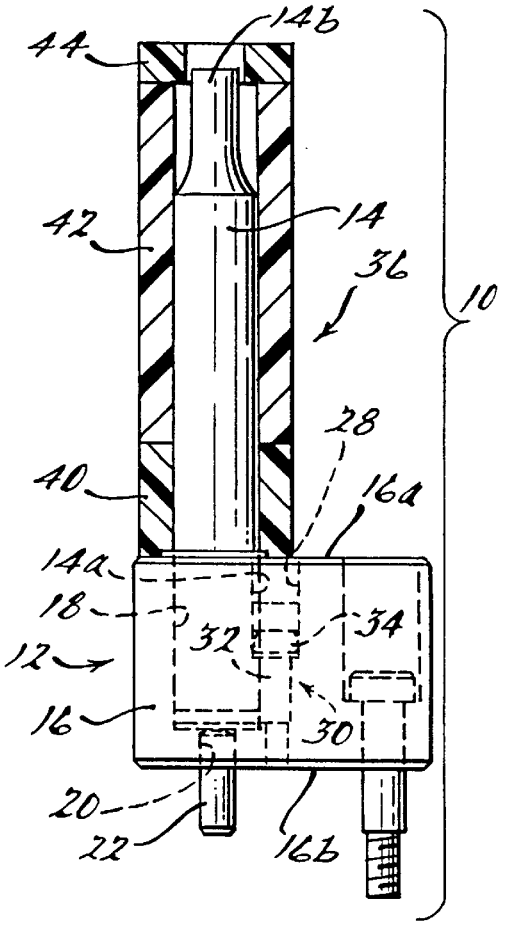
FIG. 2 is a cross-section of a punch assembly taken along line 2—2 shown in FIG. 1.

With reference to the figures, punch assembly 10 includes punch holder 12 having punch 14 extending from body 16. More specifically, as best seen in FIG. 2, blind bore 18 extends into body 16 from an upper surface 16*a* thereof and is adapted to receive punch 14. Throughbore 20 is axially aligned with and extends into blind bore 18 from a lower surface 16*b* of body 16 and is adapted to receive locating pin 22. A second throughbore 24 is formed in body 16 and is adapted to receive socket head cap screw 26. In this manner, punch assembly 10 may be releasably secured to a movable die (not shown) of a joint forming apparatus.

Body 16 further includes throughbore 28 extending therethrough to receive retainer assembly 30 for releasably securing punch 14 within punch holder 12. More specifically, retainer assembly 30 includes bolt 32 and retaining washer 34 received within throughbore 28. Retainer washer 34 is threadedly secured within throughbore 28. As retaining bolt 32 is tightened down, retaining washer 34 engages a shoulder portion 14*a* of punch 14, thereby releasably securing punch 14 within punch holder 12.

Figure 3:
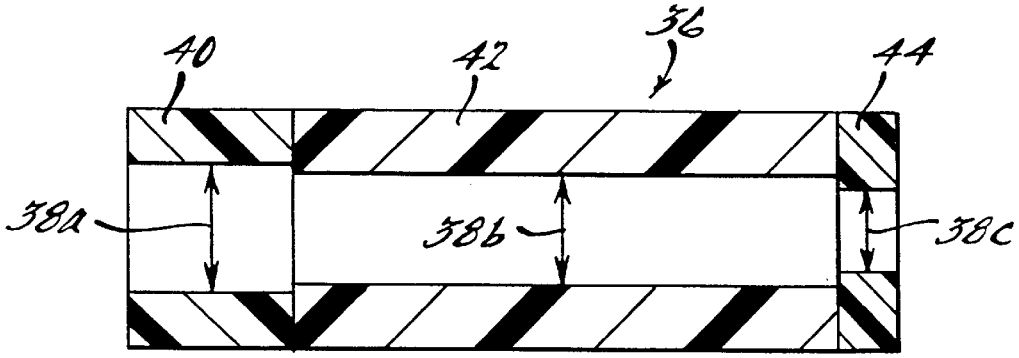
FIG. 3 is a cross-sectional view of the molded composite urethane stripper of FIG. 2.

Composite stripper 36 is an elongated cylindrical member having a longitudinal bore 38 formed therethrough which is adapted to receive punch 14. Composite stripper 36 includes base section 40, middle spring section 42 and tip section 44. As best seen in FIG. 3, the inside diameter of bore 38 varies through base section 40, middle section 42 and top section 44. More specifically, the inside diameter 38*b* of middle section 42 is slightly less than the outside diameter of punch 14, and therefore is used to retain stripper 36 on the shank of punch 14 by a slight "press" or interference fit. The inside diameter 38*a* of base portion 40 is slightly larger than the outside diameter of punch 14 to provide a clearance for the shank of punch 14. Similarly, the inside diameter 38*c* of tip portion 44 is slightly larger than the outside diameter of the tip 14*a* of punch 14 to provide a slight clearance around the tip 14*b* of punch 14. The portion of throughbore 38*a*, 38*c* associated with base portion 40 and tip portion 44 may be molded or machined to suit the specific geometric shape of punch 14.

As presently preferred, stripper 36 is of a composite construction in that it incorporates materials of varying hardness for achieving different functional features. As presently preferred, base portion 40 and tip portion 44 are made from a relatively hard durometer urethane, preferably of a hardness of approximately 75 D, to provide proper support and wear characteristics, while middle portion 42 is made from a relatively soft durometer urethane, preferably of a hardness of approximately 95 A, to control the overall clamping force generated when the composite stripper 36 is compressed. More specifically, the hard urethane on base portion 40 prevents extrusion of composite stripper 36 into any adjacent hole, such as throughbore 28 of punch holder 12. This eliminates the need for a metal washer supporting composite stripper 36. Utilizing hard urethane for tip portion 44 resists marring the material being stripped, a problem commonly encountered in the use of standard metal stripper tips. Furthermore, utilizing a relatively hard urethane tip minimizes the wear on composite stripper 36 associated with the repeated cycling during the adjoining operation. The use of a softer durometer urethane for middle section 42 provides sufficient compliance to generate the compression force necessary to adequately hold and clamp the material being joined. This gives a reliable stripping force with a consistent range of compression. Middle portion 42 and tip portion 44 of composite stripper 36 are preferably of a constant length regardless of the length of the punch used. In contrast, the length of base portion 40 may be modified to provide a desired overall length of composite stripper 36.

Composite stripper 36 may be fabricated using a sequential process molding tip portion 44, middle portion 42 and the base part 40. Alternately, composite stripper may be fabricated by placing base portion 40 and tip portion 44 into a suitable mold and injection molding middle portion 42 in a manner sufficient to bond base and tip portions 40, 44 thereto. One skilled in the art will also recognize that other molding processes may be adapted for a given composite stripper configuration. Furthermore, colors may be utilized in the fabrication of composite stripper to specifically identify the stripper, e.g. heavy-duty versus medium-duty stripping forces, as well as to suit safety requirements, e.g. orange-colored tip portion. In addition, various logos and/or part numbers may be molded into the end face portion 44 prior to the insert molding process.

The composite stripper of the present invention allows for closer joining or piercing center distances than steel spring stripper assemblies with comparable forces. Moreover, the overall size of composite stripper 36 is smaller than conventional steel spring stripper which require larger encasements for constraining the coil spring. One skilled in the art will readily recognize that the overall length and effective compliance of composite stripper 36 is dictated by the particular apparatus, the joining process and the desired clamping forces. As such, the specific materials and the hardness of such materials associated with a composite stripper may be modified without deviating from the spirit and scope of the present invention. In this regard, a urethane polymer is the presently preferred material, however other suitable plastics which provide the desired durability, wear, compliance and hardness characteristics may be substitute, and thus are considered within the scope of the present invention. Furthermore, one skilled in the art will readily recognize that the specific spring force generated by composite stripper 36 is primarily dictated by the geometry, length and wall thickness, as well as the material selection of middle portion 42. In this regard, one skilled in the art will readily appreciate that the present invention contemplates the use of strippers having various cylindrical configurations as well as cones and various polyhedral configurations may be incorporated into the present invention, and thus are considered within the scope of the present invention.

Figure 4:
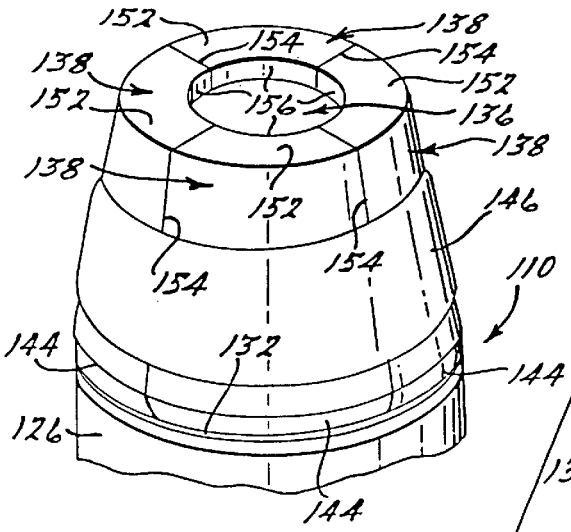
FIG. 4 is a partial perspective view of the apparatus which is applicable to the formation of a leakproof joint according to the present invention.
Figure 5:
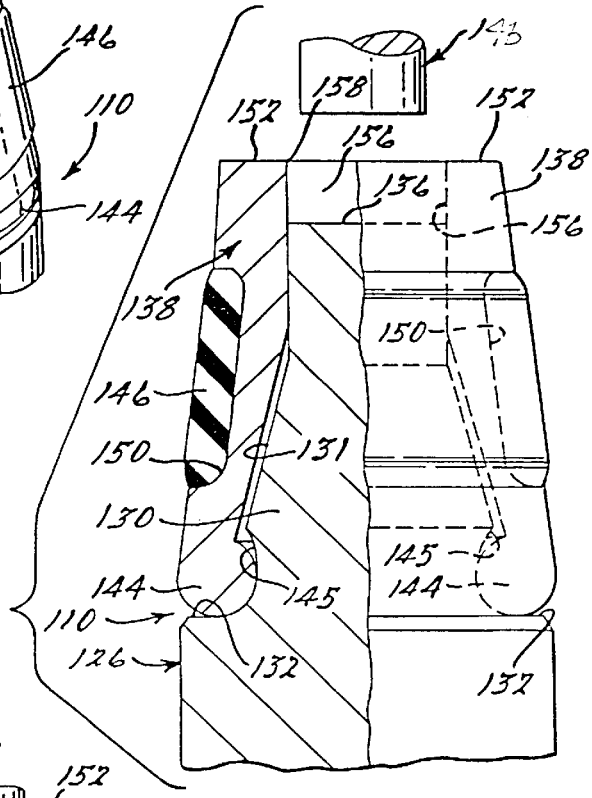
FIG. 5 is a partial elevational view of the apparatus of FIG. 4, with a portion of the apparatus shown in longitudinal cross-section.
Figure 6:
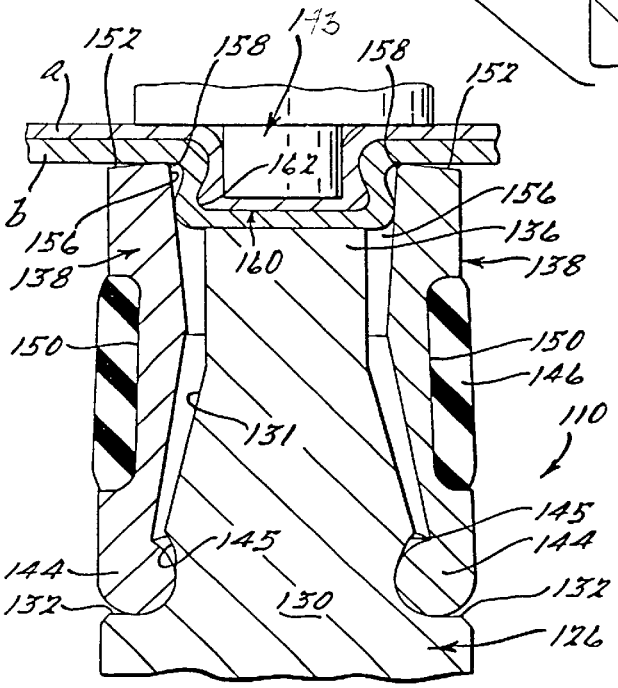
FIG. 6 is a partial sectional view of the apparatus of FIGS. 4 and 5, illustrating the apparatus substantially at the point of completion of a leakproof joint according to the present invention.

Turning now to FIGS. 4–6, an exemplary die assembly 110, which is adapted to cooperate with punch 14 to form a leakproof joint is shown. Die assembly 110 includes die body 126 having an integral boss 130 and a circular annular shoulder 132 thereon. Integral boss 130 includes conical portion 131 interconnecting an anvil 136 with shoulder 132.

Two or more arcuate die segments 138 are disposed around boss 130 and include die segment shoulders 144, which are supported and engaged by shoulder 132 of die body 126. Boss 130 is provided with a circular annular relieved portion 145 adjacent the shoulder 132. This relieved portion 145 provides clearance so that the die segments 138 can primarily pivot outwardly about a lateral axis as the joint is being completed.

Die portions 138 are maintained in their normally-closed position, shown in FIG. 4, by means of a resilient, elastomeric band 146, which surrounds the lateral sides of die segments 138 in order to resiliently bias die segments 138 in a laterally inward direction toward the longitudinal axis of the die assembly. Resilient band 146 is received within, and longitudinally restrained by, a laterally inwardly recessed groove 150 extending circumferentially around the die segments 138. Although resilient band 146 can be composed of any of a wide variety of elastomeric materials suitable for particular applications of the present invention, it is preferred that resilient band 146 be composed of a urethane or urethane-containing material.

When die segments 138 are in their closed positions illustrated in FIG. 4, the upper surfaces 152 lie in a common plane and the abutting faces of adjacent die segments lie in planes indicated by reference numeral 154. In the embodiment shown in FIG. 4, die portions 138 are provided with circular inside faces or recesses 156 that define a circular opening generally complementary with the lateral cross-sectional shape of punch 14. Die portions 138 are also provided with radiused edge portions 158, and are preferably uniformly spaced from punch 14, in order to substantially avoid shearing or tearing sheet material items a and b during the deformation of sheet material. The downward force exerted on die portions 138 by punch 14 will tend (at least initially) to close, rather than open, the die assembly 110. This is because the primarily pivotal and longitudinally supported engagement of die segment shoulders 144 with die body shoulder 132 is at a laterally-outward position relative to edge portions 158. Furthermore, shoulder 132 defines a solid surface easily capable of handling the axial loads on die segments 138 during operation of the apparatus.

During operation, the action of punch 14 against anvil 136 causes lateral extrusion of the sheet material portions 160 to form the leakproof joint, in the manner illustrated in FIG. 6. The resilient band 146, in addition to contributing to a uniform and controlled formation of a joint, also provides substantial simplicity and economy in the manufacture, operation and maintenance of the die assembly.

Figure 7:
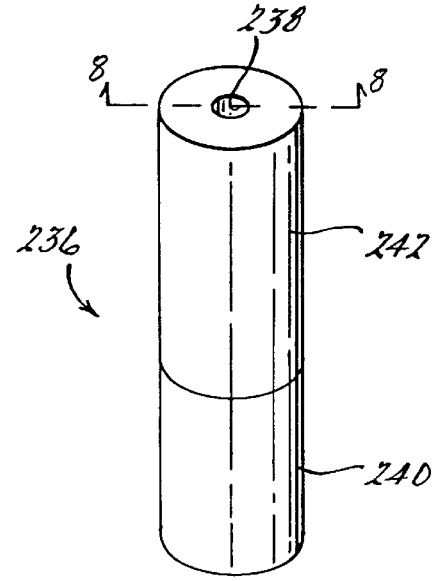
FIG. 7 is a perspective view of a punch assembly having a molded two-piece composite urethane stripper according to a second embodiment.
Figure 8:
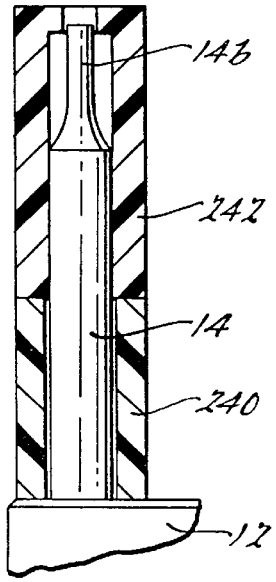
FIG. 8 is a cross-section of the punch assembly of FIG. 7 taken along line 8—8.
Figure 9:
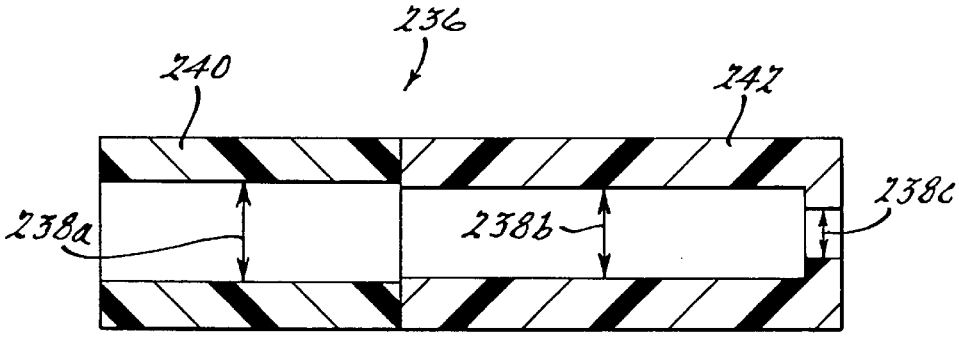
FIG. 9 is a cross-sectional view of the molded composite urethane stripper of FIG. 8.

Turning now to FIGS. 7–9, an alternate embodiment incorporating a two piece stripper 236 is provided according to a second embodiment wherein like reference numbers increased by 200 over those used in conjunction with composite stripper 36 will be used to designate like components. In addition, it will be appreciated that composite stripper 236 may be fabricated using the molding processes as described herein in relation to composite stripper 36.

Composite stripper 236 is an elongated cylindrical member having a longitudinal bore 238. Composite stripper 236 includes base section 240 and tip section 242. As best seen in FIG. 9, the inside diameter of bore 238 varies between base section 240 and tip section 242. Explained further, the inside diameter 238*a* of base section 240 is slightly larger than the outside diameter of punch 14 to provide a clearance for the shank of punch 14. The inside diameter 238*b* of tip section 242 is slightly smaller than the outside diameter of punch 14 to provide a friction or interference fit.

As with composite stripper 36, composite stripper 236 incorporates materials of varying hardness. In this way, base section 240 is preferably made of a relatively hard durometer urethane, preferably of a hardness of approximately 75 D, to provide sufficient support and wear characteristics. Tip section 242 is preferably made of a relatively soft durometer urethane, preferably of a hardness of approximately 95 A, to control the overall clamping force generated when the composite stripper 236 is compressed. The preferred materials as described being associated with composite stripper 236 provide the advantages associated with previously described stripper 36. In this regard, utilizing a softer durometer urethane for tip section 242 provides sufficient compliance to generate the compression force necessary to adequately hold and clamp the material being joined. In addition, the hard urethane of base 240 prevents extrusion of composite stripper 236 into any adjacent hole, such as a throughbore incorporated in a punch holder. Tip section 242 is made of a distinct color from the base section 240. Accordingly, tip section 242 is preferably made of a bright color, such as but not limited to, yellow to designate the area of visual interest to a user. Base section 240 is preferably made of a distinct color from said tip section 242 such as but not limited to safety orange.

The foregoing discloses and describes an exemplary embodiment of the present invention. One skilled in the art will readily recognize from such discussion, and from the accompanying drawings, that various changes, modifications and variations may be made therein without departing from the spirit and scope of the invention as defined in the following claims.

What is claimed is:

1. A composite stripper for use with a punch assembly comprising an integrally formed elongated member having a longitudinal bore formed therethrough for receiving a punch, said elongated member including a first axial portion formed in a distal end of the stripper and a second axial portion formed on a proximal end of the stripper, said second axial portion having a hard polymeric material relative to said first axial portion for resisting wear of said elongated member, and said longitudinal bore through said second axial portion forming a clearance fit with said punch and said longitudinal bore through said first axial portion forming an interference fit with said punch.

2. The composite stripper of claim 1 wherein said elongated member has a circular cross-section.

3. The composite stripper of claim 1 wherein said longitudinal bore formed through said first axial portion has a diameter which is less than said longitudinal bore formed through said second axial portion.

4. The composite stripper of claim 1 wherein said first axial portion is a first color and said second axial portion is a second color distinct from said first color.

5. A composite stripper for use with a punch assembly, said composite stripper comprising:

an integrally formed elongated member having a first axial portion arranged on a distal end of the stripper including a first longitudinal bore formed therethrough, and a second axial portion arranged on a proximal end of the stripper including a second longitudinal bore formed therethrough, said first axial longitudinal bore of said first axial portion forming a friction fit with the punch in an at rest position, said second longitudinal bore of said second axial portion forming a clearance fit with the punch for permitting axial movement of the punch through said second axial portion.

6. The composite stripper of claim 5 wherein said elongated member has a circular cross-section.

7. The composite stripper of claim 5 wherein said first longitudinal bore formed through said first axial portion has a diameter which is less than said second longitudinal bore formed through said second axial portion.

8. The composite stripper of claim 5 wherein said first axial portion is a first color and said second axial portion is a second color distinct from said first color.

9. A punch assembly, comprising:

a punch;

a composite stripper having first and second axial portions forming an integral continuous longitudinal bore extending therethrough, said first axial portion arranged on a distal end of the punch and having a soft material relative to the second axial portion;

a plurality of die portions defining a die opening in the punch assembly for receiving said punch said die portions uniformly biased radially inward; and an anvil disposed within said die opening, said die portions being movable away from one another thereby overcoming said uniform bias from a closed position to an open position in response to said punch compressing working material into said die opening and against said anvil thereby causing said working material to deform generally laterally outwardly in said die opening without shearing said working material.

10. The punch assembly of claim 9 wherein said elongated member has a circular cross-section.

11. The punch assembly of claim 9, wherein said longitudinal bore formed through said first axial portion has a diameter which is less than said longitudinal bore formed through said second axial portion.

12. The punch assembly of claim 9 wherein said first axial portion is formed of a urethane plastic having a durometer of approximately 95 A, and said second axial portion is formed of a urethane plastic having a durometer of approximately 75 D.

13. The punch assembly of claim 9 wherein said first axial portion is a first color and said second axial portion is a second color distinct from said first color.

* * * * *

UNITED STATES PATENT AND TRADEMARK OFFICE

CERTIFICATE OF CORRECTION

PATENT NO. : 6,757,951 B2 
DATED : July 6, 2004
INVENTOR(S) : Edwin G. Sawdon and Steven J. Sprotberry It is certified that error appears in the above-identified patent and that said Letters Patent is hereby corrected as shown below:

Title page,
Item [*] Notice, "bydays.days" should be -- 15 days --; and "0 days" should be -- 15 days --.

Column 1,
Line 4, after "of" insert -- copending --.

Column 2,
Line 17, "taking" should be -- taken --.

Column 4,
Line 24, "substitute" should be -- substituted --.

Signed and Sealed this

Fourth Day of April, 2006

JON W. DUDAS
*Director of the United States Patent and Trademark Office*